US008491328B2

(12) United States Patent
Mulfinger et al.

(10) Patent No.: US 8,491,328 B2
(45) Date of Patent: Jul. 23, 2013

(54) ELECTRICAL CONNECTOR FOR TERMINATING A CABLE

(75) Inventors: Robert Neil Mulfinger, York Haven, PA (US); Lawrence Se-Jun Oh, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/278,937

(22) Filed: Oct. 21, 2011

(65) Prior Publication Data

US 2013/0102185 A1 Apr. 25, 2013

(51) Int. Cl.
*H01R 13/56* (2006.01)

(52) U.S. Cl.
USPC ..... 439/447; 439/471

(58) Field of Classification Search
USPC ..... 439/445–473
See application file for complete search history.

(56) References Cited

U.S. PATENT DOCUMENTS 2,047,126 A * 7/1936 Hastings ..... 439/319
4,108,527 A 8/1978 Douty et al.
4,422,706 A 12/1983 Neuhouser
5,831,815 A 11/1998 Miller et al.
2008/0009173 A1 1/2008 Carnahan et al.
2011/0136369 A1* 6/2011 Dang ..... 439/352

FOREIGN PATENT DOCUMENTS

EP 0 907 221 A2 4/1999
WO WO 97/23926 A1 7/1997

OTHER PUBLICATIONS

International Search Report, International Application No. PCT/US2012/060486, International Filing Date, Oct. 17, 2012.

* cited by examiner

*Primary Examiner* — Ross Gushi

(57) ABSTRACT

An electrical connector is provided for terminating a cable. The electrical connector includes an electrical contact configured to be terminated to a wire of the cable, and a housing extending between a mating end and a cable end. The housing is configured to mate with a mating connector at the mating end. The electrical contact is held by the housing. A back shell is mounted to the cable end of the housing. The back shell includes an opening configured to hold an end of the cable such that the back shell supports the end of the cable. The back shell includes an accessory socket. An accessory is held within the accessory socket of the back shell such that the accessory extends outwardly from the back shell. The accessory is configured to engage the cable.

10 Claims, 11 Drawing Sheets

ELECTRICAL CONNECTOR FOR TERMINATING A CABLE

BACKGROUND OF THE INVENTION

The subject matter herein relates generally to electrical connectors, and more particularly to electrical connectors that terminate cables.

Electrical connectors that terminate cables sometimes include a back shell that holds an end of the cable. More specifically, the electrical connector includes a housing that holds one or more electrical contacts of the connector that are terminated to one or more electrical conductors (e.g., an insulated electrical wire) of the cable. The back shell mounts to an end of the housing to support the end of the cable. The back shell may terminate portions of the cable, for example a shield and/or jacket of the cable. The housing, and/or an electrically conductive portion of the housing, is sometimes referred to as a "shell".

Depending on the specific applications as well as other factors, the configuration (e.g., size, shape, mechanical properties, electrical properties, and/or the like) of the housings and/or back shells of different electrical connectors may be different. Many back shells and/or housings are one-use type options that are only good for one particular use. Moreover, different back shells may require different housings, and/or vice versa. A back shell designed for use with a specific housing therefore may not be suitable for use within a different electrical connector having a differently configured housing, and/or vice versa. Accordingly, a manufacturer, supplier, and/or the like of different electrical connectors must fabricate and/or stock multiple different back shell and/or housing configurations, which may increase cost, complexity, and/or difficulty of manufacturing, supplying, and/or the like of different electrical connectors.

BRIEF DESCRIPTION OF THE INVENTION

In one embodiment, an electrical connector is provided for terminating a cable. The electrical connector includes an electrical contact configured to be terminated to a wire of the cable, and a housing extending between a mating end and a cable end. The housing is configured to mate with a mating connector at the mating end. The electrical contact is held by the housing. A back shell is mounted to the cable end of the housing. The back shell includes an opening configured to hold an end of the cable such that the back shell supports the end of the cable. The back shell includes an accessory socket. An accessory is held within the accessory socket of the back shell such that the accessory extends outwardly from the back shell. The accessory is configured to engage the cable.

In another embodiment, an electrical connector is provided for terminating a cable and includes an electrical contact configured to be terminated to a wire of the cable, and a housing extending between a mating end and a cable end. The housing is configured to mate with a mating connector at the mating end. The electrical contact is held by the housing. A strap is strapped over the cable end of the housing. An accessory extends outwardly from the strap. The accessory is configured to engage the cable.

In another embodiment, an electrical connector is provided for terminating a cable and includes an electrical contact configured to be terminated to a wire of the cable, and a housing extending between a mating end and a cable end. The housing is configured to mate with a mating connector at the mating end. The cable end has a fitting that includes an outer profile having a circular shape. The outer profile of the fitting includes a fitting flat. The electrical contact is held by the housing. A back shell is mounted to the fitting of the cable end of the housing. The back shell includes an opening configured to hold an end of the cable such that the back shell supports the end of the cable. The back shell includes a shell flat that engages the fitting flat of the housing to limit rotation of the back shell relative to the housing.

In another embodiment, an electrical connector for terminating a cable includes an electrical contact configured to be terminated to a wire of the cable, and a housing having a mating end. The housing is configured to mate with a mating connector at the mating end. The electrical contact is held by the housing. A back shell is mounted to the housing. The back shell extends a length from a housing end to a cable end. The back shell includes an opening configured to hold an end of the cable such that the back shell supports the end of the cable. An accessory is integrally formed with the back shell. The accessory extends outwardly rearward from the cable end of the back shell. The accessory is configured to engage the cable.

DETAILED DESCRIPTION OF THE INVENTION

Figure 1:
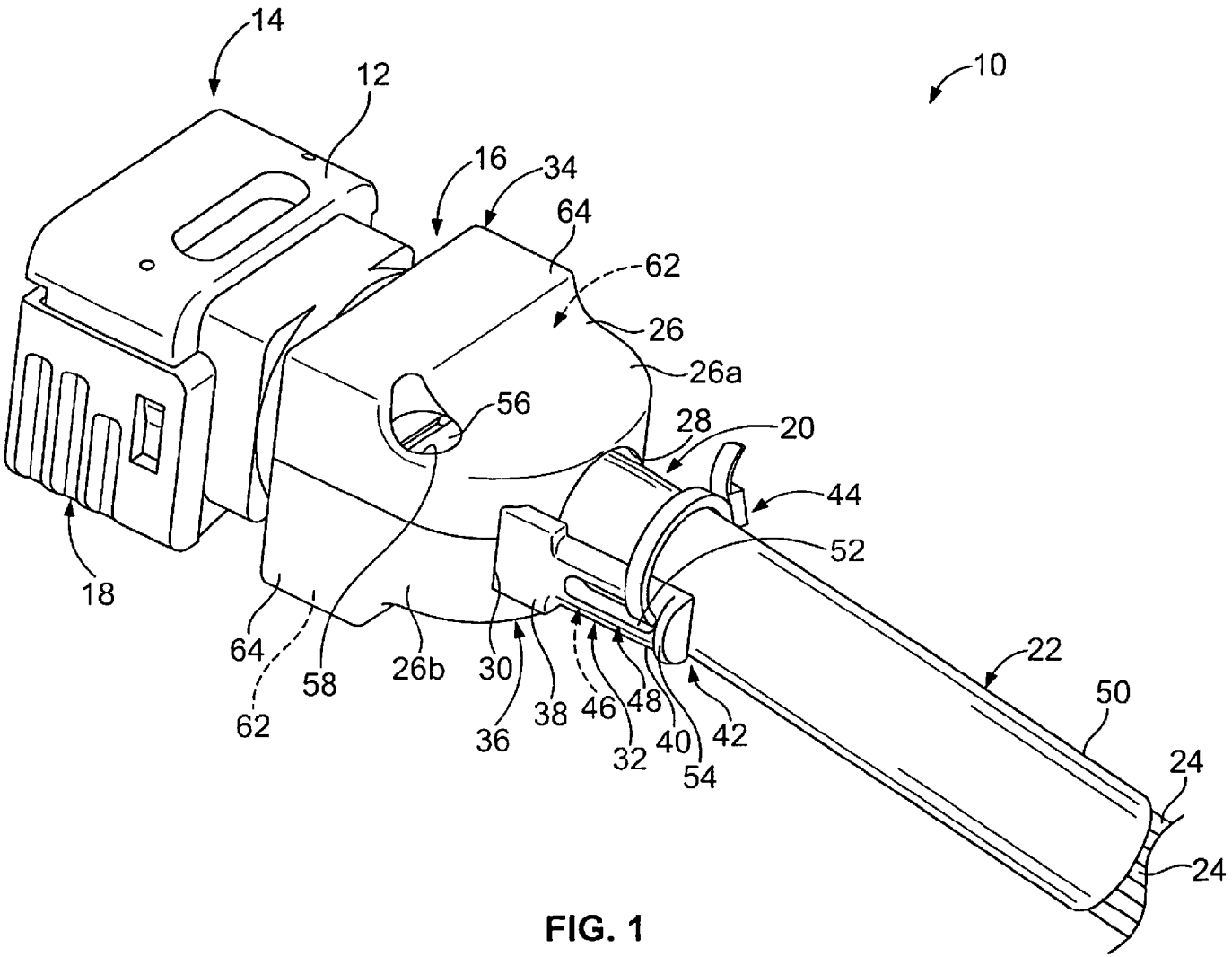
FIG. 1 is a perspective view of an exemplary embodiment of an electrical connector.

FIG. 1 is a perspective view of an exemplary embodiment of an electrical connector 10. In the exemplary embodiment, the electrical connector 10 is a shielded radio frequency (RF) connector, however another type of connector may be used in alternative embodiments. Optionally, the electrical connector 10 is a relatively high data rate connector. The electrical connector 10 is optionally adapted for use in military applications, aerospace applications, automotive applications, industrial applications, commercial applications, and/or the like.

The electrical connector 10 includes a housing 12 extending between a mating end 14 and a cable end 16. The electrical connector 10 is configured to mate with a mating connector (not shown) at the mating end 14 of the housing 12. When mated together, the electrical connector 10 and the mating connector are optionally secured together using a lock 18. In the exemplary embodiment, the lock 18 is a latch, however other types of locks may be used in alternative embodiments, such as, but not limited to, using a threaded connection, using fasteners, and/or the like.

The electrical connector 10 terminates the end 20 of a cable 22, which includes a plurality of insulated wires 24 in the exemplary embodiment. The cable 22 may include any number of the wires 24. Optionally, the wires 24 are arranged as twisted wire pairs, where the wires carry differential signals.

A back shell 26 of the electrical connector 10 is mounted to the cable end 16 of the housing 12. The back shell 26 facilitates connecting the end 20 of the cable 22 to the housing 12. The back shell 26 includes an opening 28 that holds the end 20 of the cable 22 such that the back shell 26 supports the cable end 20. As will be described below, the back shell 26 includes an accessory socket 30 that holds an accessory 32, which extends outwardly from the back shell 26 and engages the cable 22.

Figure 2:
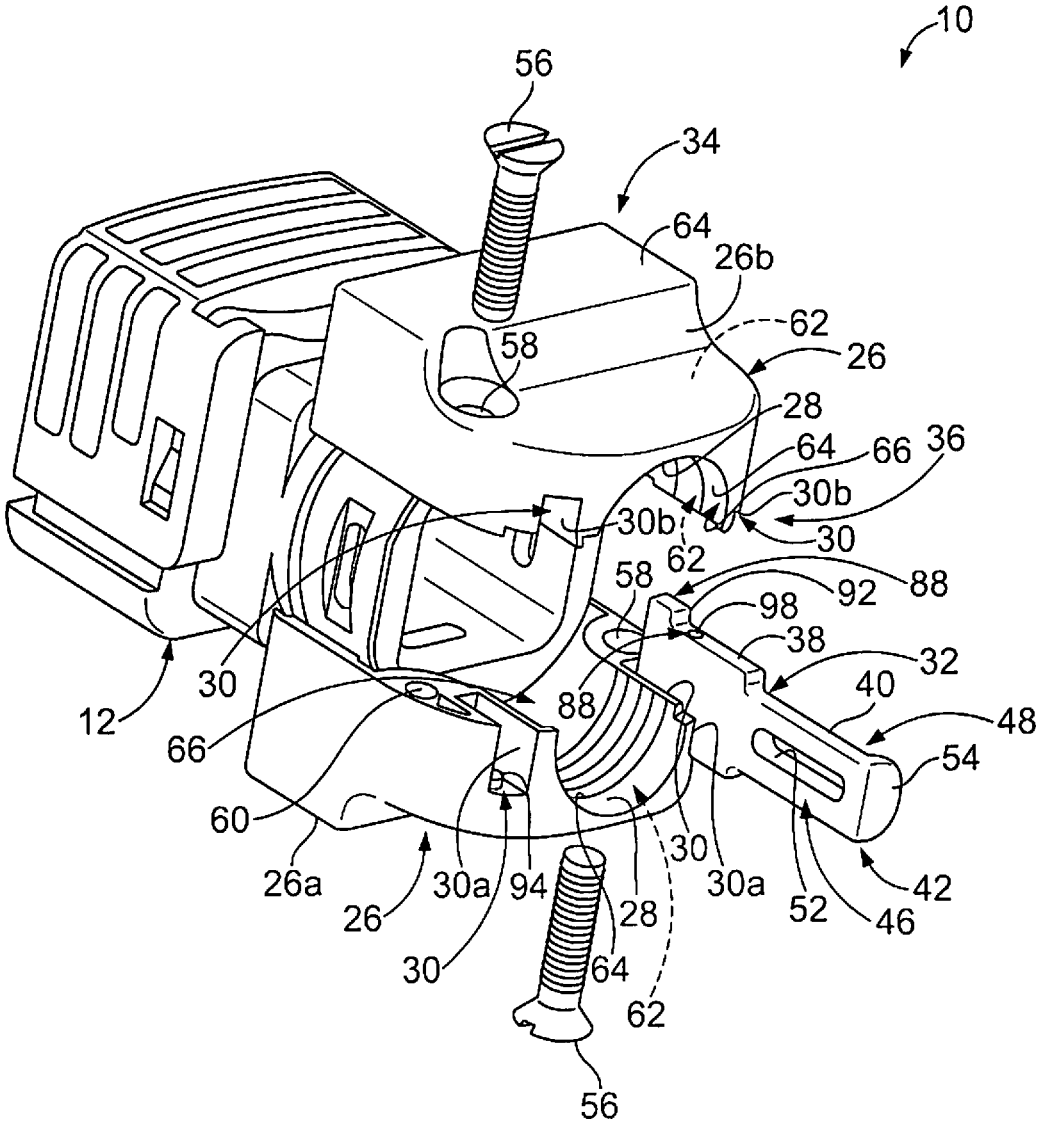
FIG. 2 is an exploded perspective view of the electrical connector shown in FIG. 1.

FIG. 2 is an exploded perspective view of the electrical connector 10. Referring now to FIGS. 1 and 2, the back shell 26 of the electrical connector 10 extends a length from a housing end 34 to a cable end 36. The back shell 26 mounts to the housing 12 at the housing end 34. The back shell 26 holds the cable 22 (not shown in FIG. 2) at the cable end 36.

The back shell 26 includes the accessory socket 30. As can be seen in FIGS. 1 and 2, the opening 28 of the back shell 26 that holds the end 20 of the cable 22 is separate from the accessory socket 30 in that the opening 28 and the accessory socket 30 do not connect (e.g., fluidly communicate) within the back shell 26. The accessory 32 is held within the accessory socket 30 such that the accessory 32 extends outwardly from the back shell 26. The accessory 32 is configured to engage the cable 22. In the exemplary embodiment, the accessory socket 30 extends into the back shell 26 through the cable end 36 of the back shell 26 such that the accessory 32 extends outwardly from the cable end 36. But, the accessory socket 30 may extend into the back shell 26 at any other location along the back shell 26 and the accessory 32 may extend outwardly from any other location along the back shell 26 that enable the accessory 32 to engage the cable 22.

The accessory 32 includes a base 38 and a tie bar 40. The base 38 is held within the accessory socket 30. The tie bar 40 extends outwardly from the base 38 and outwardly from the back shell 26 to an end 42. The tie bar 40 is configured to be held against the cable 22 using a fastener 44 (not shown in FIG. 2). The tie bar 40 includes an inner side 46 and an opposite outer side 48. The inner side 46 is configured to engage the cable 22. More specifically, the inner side 46 engages a jacket 50 of the cable 22. The inner side 46 of the tie bar 40 optionally includes a curved shape that is complementary to the circular circumference of the jacket 50. Optionally, an opening 52 extends through the tie bar 40 for receiving the fastener 44 therethrough. The opening 52 may have any shape for receiving a fastener having any shape. The tie bar 40 includes an optional flange 54. Although shown at the end 42 of the tie bar 40, the flange 54 may be located at any location along the length of the tie bar 40.

Referring now solely to FIG. 1, the tie bar 40 of the accessory 32 is shown held against the cable 22 using the fastener 44. When engaged with the cable 22 as shown in FIG. 1, the tie bar 40 provides strain relief between the cable 22 and the back shell 26. In the exemplary embodiment, the fastener 44 is a zip tie (sometimes referred to as a "tie wrap") that extends through the opening 52 within the tie bar 40. The fastener 44 extends over a portion of the outer side 48 of the tie bar 40 and around the cable 22 to hold the tie bar 40 against the cable 22. More specifically, the fastener 44 holds the inner side 44 of the tie bar 40 in engagement with the jacket 50 of the cable 22. In some alternative embodiments, the fastener 44 does not extend through the opening 52, but extends over the outer side 48 of the tie bar 40 and around the cable 22 to hold the tie bar 40 in engagement with the jacket 50 of the cable 22. The flange 54 of the tie bar 40 may facilitate preventing the fastener 44 from moving off the tie bar 40 in the direction of the arrow A.

Although the fastener 44 is shown as a zip tie, the fastener 44 may be any other type of fastener that is capable of holding the tie bar 40 against the cable 22 as shown and/or described herein, such as, but not limited to, a wire, a string, rope, a band, a clamp, an elastic (e.g., rubber) band, a twist tie, safety wire, and/or the like. In some embodiments, a plurality of the same or two or more different types of fasteners may be used to hold the tie bar 40 against the cable 22.

Referring again to FIGS. 1 and 2, the accessory 32 shown in FIGS. 1 and 2 is merely one example of a type of accessory that may be held in the accessory socket 30. Examples of other types of accessories that may be held in the accessory socket 30 are shown and described herein with reference to FIGS. 3-6. The electrical connectors described and/or illustrated herein are not limited to the accessories shown and/or described herein, but rather the accessory sockets 30 may hold any type of accessory.

Although the back shell 26 is shown herein as including two accessory sockets 30, the back shell 26 may include any number of the accessory sockets 30. Each accessory socket 30 may selectively hold any type of accessory (e.g., an accessory 32). For example, in the exemplary embodiment, the back shell 26 includes two accessory sockets 30, wherein one of the accessory sockets 30 holds an accessory 32 and the other accessory socket 30 does not hold an accessory. In other embodiments, both accessory sockets 30 hold an accessory 32, one of the accessory sockets 30 holds an accessory 32 while the other accessory socket 30 holds a different type of accessory, one of the accessory sockets 30 holds a different type of accessory than the accessory 32 while the other accessory socket 30 does not hold an accessory, or both accessory sockets 30 hold a different type of accessory than the accessory 32. Moreover, in some embodiments, a single accessory is held by two or more accessory sockets 30 of the back shell 26. For example, an accessory may include two or more bases and one or more structures that extend from the bases for engagement with the cable 22, wherein each base of the accessory is held by a different accessory socket 30.

In the exemplary embodiment, the cable 22 extends outwardly from the back shell 26 in a direction that is approximately parallel to a central longitudinal axis 160 of the electrical connector 10. But, the cable 22 may extend outwardly from the back shell 26 in any other direction relative to the central longitudinal axis 160, such as, but not limited to, an approximately perpendicular angle or an oblique angle.

Figure 3:
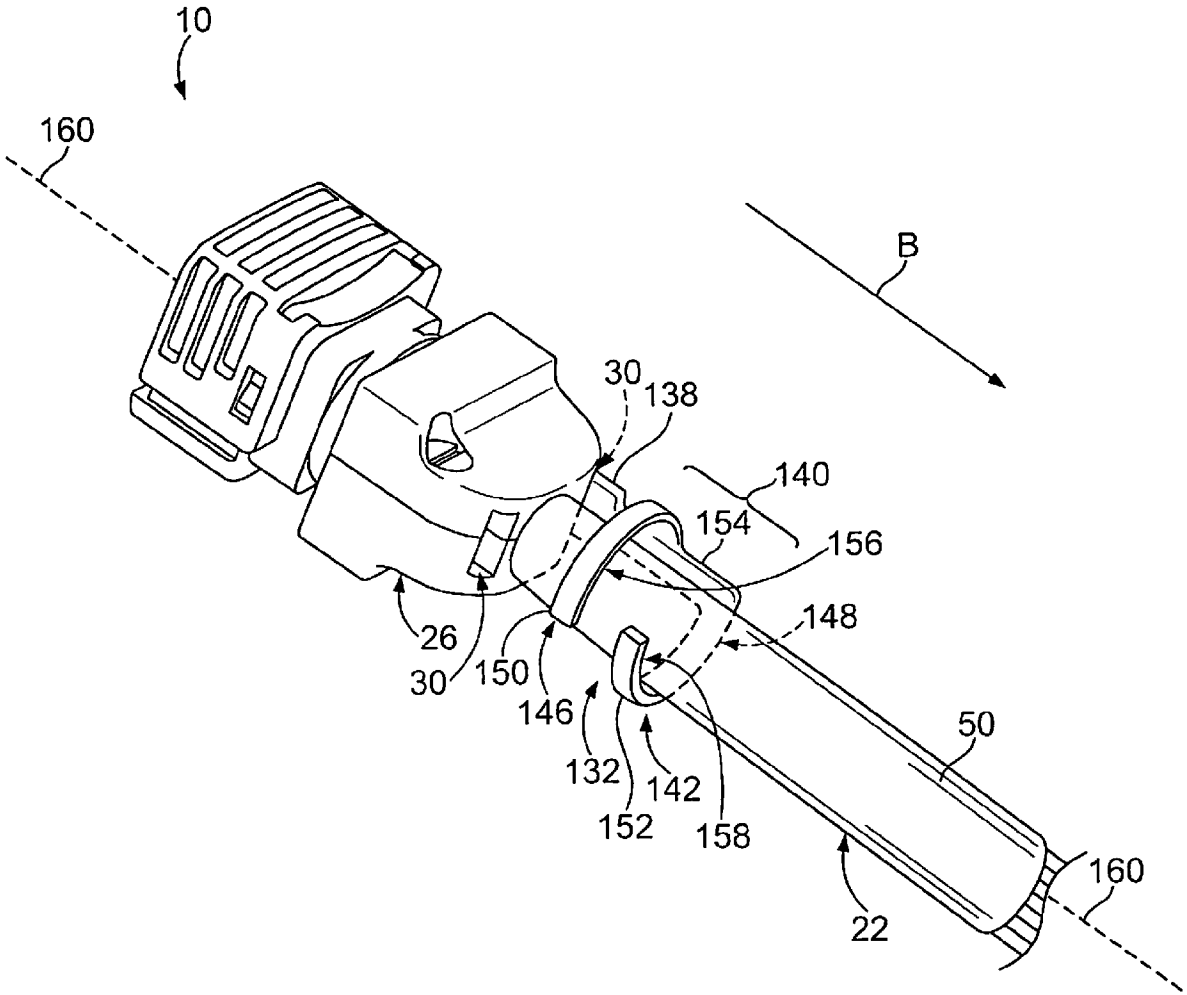
FIG. 3 is perspective view of the electrical connector shown in FIGS. 1 and 2 illustrating an exemplary alternative embodiment of an accessory of the electrical connector.

FIG. 3 is perspective view of the electrical connector 10 illustrating an exemplary alternative embodiment of an accessory 132 of the electrical connector 10. The accessory 132 includes a clip segment 140 that snaps over the cable 22. The accessory 132 is held within one of the accessory sockets 30 of the back shell 26 such that the accessory 132 extends outwardly from the back shell 26 and engages the cable 22.

The accessory 132 includes a base 138 and the clip segment 140. The base 138 is held within the accessory socket 30. The clip segment 140 extends outwardly from the base 138 and outwardly from the back shell 26 to an end 142. The clip segment 140 includes one or more clips 146 and 148. The clips 146 and 148 are defined by respective arms 150 and 152 that extend from a stem 154 of the clip segment 140. The arms 150 and 152 include inner sides 156 and 158, respectively, and have curved shapes that are complementary to the circular circumference of the cable 22. The curved shapes of the clips 146 and 148 define cradles that are configured to hold the cable 22 therein. Each clip 146 and 148 may have any location along the length of the clip segment 140. In the exemplary embodiment, each clip 146 and 148 is configured to connect to the cable 22 with a snap-fit connection. More specifically, the arms 150 and 152 are resiliently deflectable such that the clips 146 and 148 snap over the cable 22. Although two are shown, the accessory 132 may include any number of the clips 146 and 148.

When the cable 22 is held by the clip segment 140 as shown in FIG. 3, the cable 22 extends outwardly from the back shell 26 in a direction B that is approximately parallel to a central longitudinal axis 160 of the electrical connector 10. The inner sides 156 and 158 of the clips 146 and 148, respectively, are engaged with the cable 22. More specifically, the inner sides 156 and 158 are engaged with the jacket 50 of the cable 22. The clip segment 140 provides strain relief between the cable 22 and the back shell 26.

Figure 4:
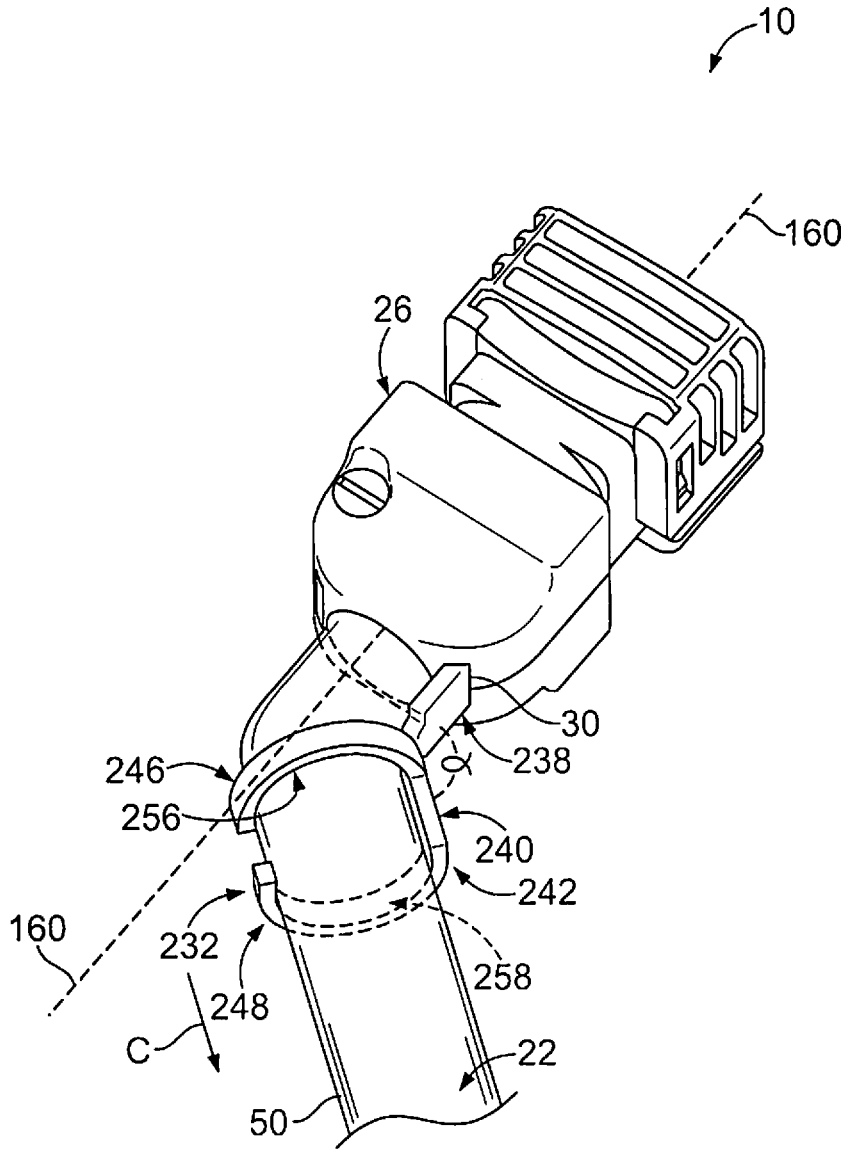
FIG. 4 is perspective view of the electrical connector shown in FIGS. 1 and 2 illustrating another exemplary alternative embodiment of an accessory of the electrical connector.

FIG. 4 is perspective view of the electrical connector 10 illustrating another exemplary alternative embodiment of an accessory 232 of the electrical connector 10. When the cable 22 is held by the accessory 232, the cable 22 extends outwardly from the back shell 26 in a direction C that is non-parallel to the central longitudinal axis 160 of the electrical connector 10. The accessory 232 is held within one of the accessory sockets 30 of the back shell 26 such that the accessory 232 extends outwardly from the back shell 26 and engages the cable 22. The accessory 232 includes a base 238 and a clip segment 240. The base 238 is held within the accessory socket 30. The clip segment 240 extends outwardly from the base 238 and outwardly from the back shell 26 to an end 242. The clip segment 240 extends outwardly from the base 238 at any non-parallel angle $\alpha$ relative to the base 238. In the exemplary embodiment, the angle $\alpha$ is an oblique angle, but the angle $\alpha$ may be any other non-parallel angle, such as, but not limited to, an angle of approximately 90°.

The clip segment 240 includes one or more clips 246 and 248 having a curved shape that is complementary to the circular circumference of the cable 22. The clips 246 and 248 include inner sides 256 and 258, respectively. The curved shapes of the clips 246 and 248 define cradles that are configured to hold the cable 22 therein. In the exemplary embodiment, each clip 246 and 248 is configured to connect to the cable 22 with a snap-fit connection. Although two are shown, the accessory 232 may include any number of the clips 246 and 248. Each clip 246 and 248 may have any location along the length of the clip segment 240.

When the cable 22 is held by the clip segment 240, the cable 22 extends outwardly from the back shell 26 in a direction C that is non-parallel to the central longitudinal axis 160 of the electrical connector 10. The direction C may be any direction that is non-parallel to the central longitudinal axis 160. In the exemplary embodiment, the direction C extends obliquely relative to the central longitudinal axis 160, but the direction C may extend at any non-parallel angle relative to the axis 160, such as, but not limited to, an angle of approximately 90° relative to the axis 160. The inner sides 256 and 258 of the respective clips 246 and 248 are engaged with the jacket 50 of the cable 22. The clip segment 240 provides strain relief between the cable 22 and the back shell 26.

In the exemplary embodiment, the non-parallel (relative to the axis 160) direction C of the cable 22 is provided by the angle $\alpha$ of the clip segment 240 relative to the base 238. In addition or alternatively, the non-parallel (relative to the axis 160) direction C of the cable 22 is provided by one or more bends (not shown) of the base 238, an orientation and/or location of the corresponding accessory socket 30, and/or the like.

Figure 5:
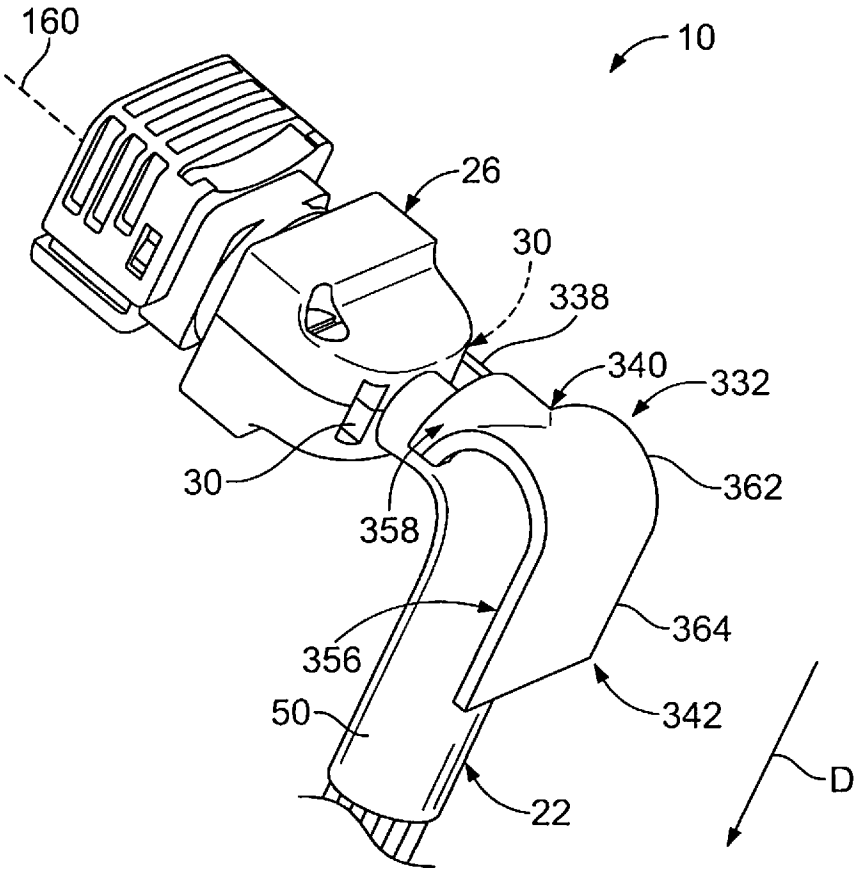
FIG. 5 is perspective view of the electrical connector shown in FIGS. 1 and 2 illustrating another exemplary alternative embodiment of an accessory of the electrical connector.

FIG. 5 is perspective view of the electrical connector 10 illustrating another exemplary alternative embodiment of an accessory 332 of the electrical connector 10. The accessory 332 is held within one of the accessory sockets 30 of the back shell 26 such that the accessory 332 extends outwardly from the back shell 26 and engages the cable 22. The accessory 332 is configured to shield the cable 22, as will be described below.

The accessory 332 includes a base 338 and a shield 340. The base 338 is held within the accessory socket 30. The shield 340 extends outwardly from the base 338 to an end 342. The shield 340 is configured to shield the cable 22 from heat, electromagnetic interference, cold, fluid, moisture, debris, and/or the like.

The shield 340 includes an inner side 356, an optional cradle 358, an optional bend segment 362, and an end segment 364. The end segment 364 includes the end 342. The cradle 360 includes a complementary shape to the circular circumference of the cable 22. In the exemplary embodiment, the bend segment 362 provides a bend of approximately 90° such that the end segment 364 extends approximately perpendicular to the central longitudinal axis 160 of the electrical connector 10. But, the end segment 364 of the shield 340 may extend at any angle relative to the central longitudinal axis 160, such as, but not limited to, an approximately parallel angle (when the shield 340 does not include the bend segment 364) or an oblique angle. Optionally, the cable 22 is held against the shield 340 using a fastener, such as, but not limited to, a zip tie, a wire, a string, rope, a band, a clamp, an elastic (e.g., rubber) band, a twist tie, safety wire, and/or the like. The shield 340 optionally includes one or more openings (not shown) for receiving the fastener therethrough.

As shown in FIG. 5, the shield 340 engages the cable 22. More specifically, the inner side 356 of the shield 340 engages the jacket 50 of the cable 22. When the cable 22 is engaged by the shield 340, the cable 22 extends outwardly from the back shell 26 in a direction D that is approximately perpendicular to the central longitudinal axis 160 of the electrical connector 10. But, the direction D may have any other angle relative to the central longitudinal axis 160, such as, but not limited to, an approximately parallel angle (when the shield 340 does not include the bend segment 364) or an oblique angle. The shield 340 shields the cable 22 from heat, electromagnetic interference, cold, fluid, moisture, debris, and/or the like.

In the exemplary embodiment, the direction D of the cable 22 is provided by the angle provided by the bend segment 362. In addition or alternatively, the direction D of the cable 22 is provided by one or more bends (not shown) of the base 338, an orientation and/or location of the corresponding accessory socket 30, and/or the like.

Figure 6:
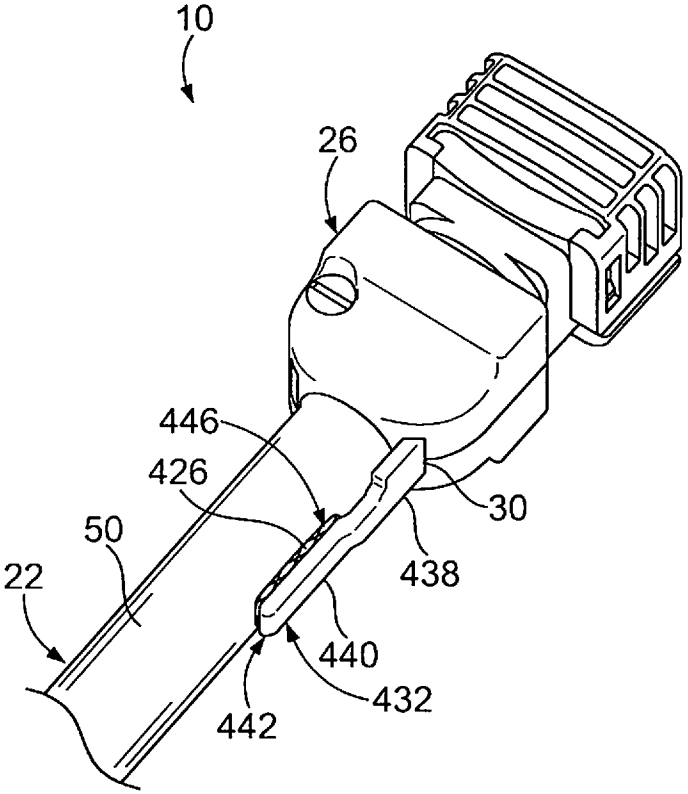
FIG. 6 is perspective view of the electrical connector shown in FIGS. 1 and 2 illustrating yet another exemplary alternative embodiment of an accessory of the electrical connector.

FIG. 6 is perspective view of the electrical connector 10 illustrating another yet exemplary alternative embodiment of an accessory 432 of the electrical connector 10. The cable 22 includes a shield 426 that surrounds the insulated wires 24 (FIGS. 1 and 11) to provide electrical shielding around the wires 24. The jacket 50 of the cable 22 surrounds the shield 426. The shield 426 is electrically conductive and may be a braid, a sheath, metallic armor, and/or the like. In addition or alternatively to the shield 426, the cable 22 may include one or more drain wires (not shown). The accessory 432 is held within one of the accessory sockets 30 of the back shell 26 such that the accessory 432 extends outwardly from the back shell 26 and engages the cable 22. More specifically, the accessory 432 engages the shield 426 of the cable 22.

The accessory 432 is electrically conductive and includes a base 438 and a ground beam 440. The base 438 is held within the accessory socket 30. The ground beam 440 extends outwardly from the base 438 to an end 442. The ground beam 440 includes an inner side 446. A portion of the shield 426 is exposed through the jacket 50 of the cable 22. The inner side 446 of the ground beam 440 is engaged with the shield 426 such that the accessory 432 is electrically connected to the shield 426 of the cable 22. Optionally, the inner side 446 of the ground beam 440 includes a curved shape that is complementary to the circular circumference of the shield 426. The accessory 432 provides an electrical connection between the shield 426 of the cable 22 and the back shell 26 of the electrical connector 10 for establishing an electrical ground path from the cable shield 426 to the connector housing 12, and vice versa. Optionally, the ground beam 440 is held against the shield 426 using a fastener (not shown), such as, but not limited to, a zip tie, a wire, a string, rope, a band, a clamp, an adhesive, an elastic (e.g., rubber) band, a twist tie, safety wire, and/or the like. The interface between the ground beam 440 and the shield 426 and any remaining exposed portions of the shield 426 may be sealed using a boot, tape, a wrapping, another structure, and/or the like.

In an alternative embodiment, the ground beam 440 of the accessory 432 engages a drain wire of the cable 22 to provide an electrical connection between the drain wire of the cable 22 and the back shell 26 of the electrical connector 10 for establishing an electrical ground path from the drain wire to the connector housing 12, and vice versa.

Figure 8:
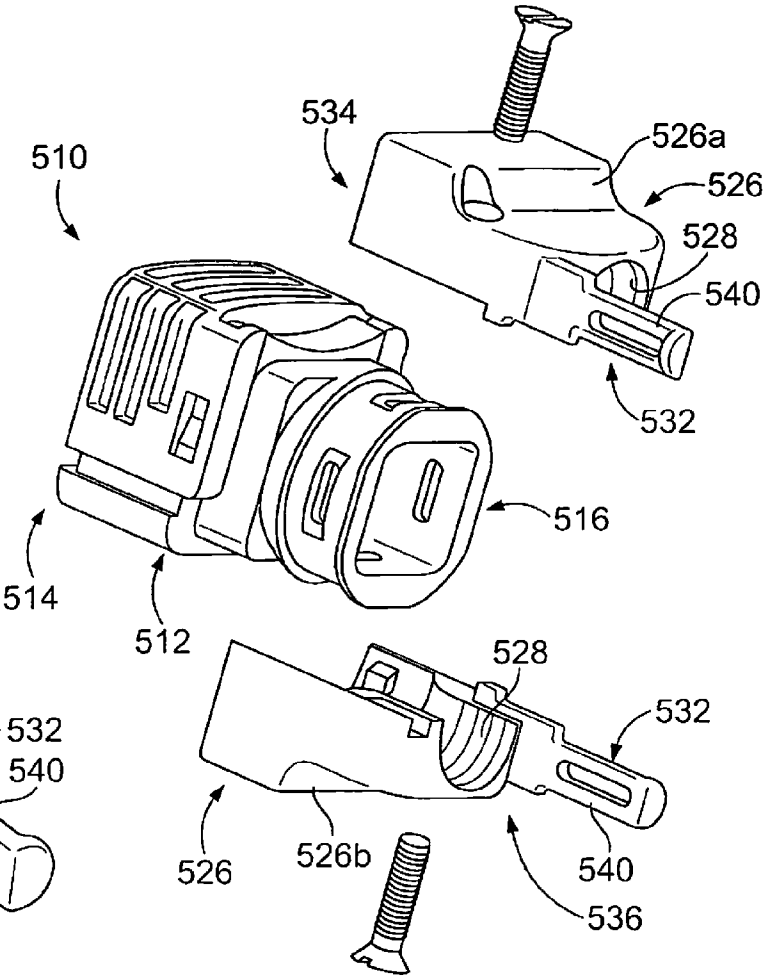
FIG. 8 is an exploded perspective view of the electrical connector shown in FIG. 8.
Figure 7:
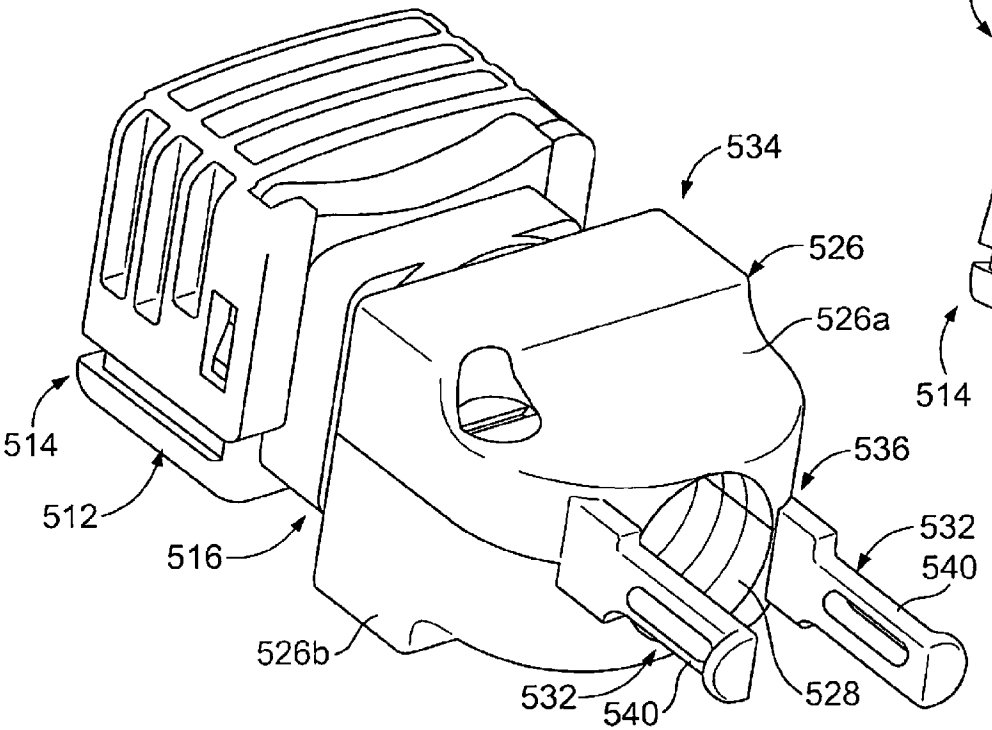
FIG. 7 is a perspective view of an exemplary alternative embodiment of an electrical connector.

FIG. 7 is a perspective view of an exemplary alternative embodiment of an electrical connector 510. FIG. 8 is an exploded perspective view of the electrical connector 510. Referring to FIGS. 7 and 8, the electrical connector 510 includes a back shell 526 having one or more accessories 532 that are integrally formed with the back shell 526. The electrical connector 510 includes a housing 512 extending between a mating end 514 and a cable end 516. The electrical connector 510 is configured to mate with a mating connector (not shown) at the mating end 514 of the housing 512. The electrical connector 510 is configured to terminate the end 20 (FIGS. 1 and 11) of the cable 22 (FIGS. 1, 3-6, 11, and 16).

The back shell 526 of the electrical connector 510 is mounted to the cable end 516 of the housing 512. The back shell 526 extends a length from a housing end 534 to a cable end 536. The back shell 526 mounts to the housing 512 at the housing end 534. The back shell 526 is configured to hold the cable 22 at the cable end 536. The back shell 526 includes an opening 528 that holds the end 20 of the cable 22 such that the back shell 526 supports the cable end 20.

One or more accessories 532 are integrally formed with the back shell 526. Alternatively, one or more accessories 532 are separately formed relative to the back shell 526 as a discrete component and thereafter connected to the back shell 526 (e.g., using an adhesive, a fastener, and/or the like). In the exemplary embodiment, the electrical connector 510 includes two accessories 532 that are integrally formed with the back shell 526. Optionally, the back shell 526 includes discrete sub-shells **526*a* and 526*b* that connect together to define the back shell 526, as can be seen in FIGS. 7 and 8. In the exemplary embodiment, and as best seen in FIG. 8, one of the accessories 532 is integrally formed with the sub-shell 526*a*, while the other accessory 532 is integrally formed with the sub-shell 526*b***.

The accessories 532 extend outwardly from the back shell 526 and are configured to engage the cable 22. In the exemplary embodiment, the accessories 532 extend outwardly rearward from the cable end 536. But, each accessory 532 may extend outwardly from any other location along the back shell 526 that enable the accessory 532 to engage the cable 22.

In exemplary embodiment, each of the accessories 532 includes a tie bar 540. As should be apparent from a comparison of FIGS. 1 and 7, each accessory 532 extends only partially around a circumference of the cable 22. But, the accessories 532 are merely one example of a type of accessory that may be used with the back shell 526. The electrical connector 510 is not limited to the accessories 532 shown and described with respect to FIGS. 7 and 8, but rather any other type(s) of accessories may be used with the back shell 526. Examples of other accessories that may be used with the back shell 526 include, but are not limited to, the accessories 132, 232, 332, and/or 432.

Each sub-shell **526*a* and 526*b* may include any number of accessories 532, whether or not the accessories 532 are formed integrally therewith. Moreover, the back shell 526 may include any number of accessories 532 overall. Although both accessories 532 are shown as the same type of accessory, two or more different types of accessories may be used with the back shell 526. Moreover, in some embodiments, a single accessory extends from two or more different locations on the back shell 526**.

Referring again to FIGS. 1 and 2, the back shell 26 of the electrical connector 10 optionally includes discrete sub-shells **26*a* and 26*b* that connect together to define the back shell 26. Optionally, the discrete sub-shells 26*a* and 26*b* are substantially identical and/or hermaphroditic. For example, the discrete sub-shells 26*a* and 26*b* are optionally fabricated using the same mold. In some embodiments, the discrete sub-shells 26*a* and 26*b* are connected together at a hinge (not shown). Although two are shown, the back shell 26 may include any number of discrete sub-shells that connect together to define the back shell 26. Alternatively, the back shell 26** is defined by a single shell, such as, but not limited to, a single rigid shell, a single shell having two or more integrally-formed sub-shells that are connected together at a hinge, and/or the like.

In the exemplary embodiment, the sub-shells **26*a* and 26*b* of the back shell 26 connect together using threaded fasteners 56. The threaded fasteners 56 extend through openings 58 of the sub-shells 26*a* and 26*b* and threadably engage threaded holes 60 (not visible in FIG. 1) of the sub-shells 26*a* and 26*b* to secure the sub-shells 26*a* and 26*b* together. In addition or alternatively to the threaded fasteners 56, openings 58, and/or threaded holes 60, any other structure, method, means, connection type, and/or the like may be used to connect the sub-shells 26*a* and 26*b* together, such as, but not limited to, using a snap-fit connection, using a latch (e.g., the back shell 926 shown in FIG. 15), and/or the like. Moreover, one or more of the threaded fasteners 56 may threadably engage a nut (not shown) instead a threaded hole 60**.

The back shell 26 optionally includes both a dielectric member 62 and an electrically conductive material 64. The electrically conductive material 64 enables the back shell 26 to electrically connect to the shield 426 (FIGS. 6 and 11) of the cable 22 (not shown in FIG. 2) and to form a portion of an electrical circuit (e.g., an electrical ground, a shield circuit, and/or the like) that includes the shield 426. The electrically conductive material 64 may extend on any amount, any portion(s), and any location(s) of the dielectric member 62 that enables the back shell 26 to electrically connect to the shield 426 and form a portion of the electrical circuit that includes the shield 426. In the exemplary embodiment, the electrically conductive material 64 extends on the dielectric member 62 at the opening 28 and at an interior side 66 (FIGS. 2 and 9) of the housing end 34 to enable the back shell 26 to electrically connect to the shield 426 and the housing 12, respectively. In some embodiments, the back shell 26 does not include the dielectric member 62 or does not include the electrically conductive material 64.

In some embodiments, the electrically conductive material 64 is a coating that coats one or more surfaces of the dielectric member 62. In other embodiments, the electrically conductive material 64 is a discrete shell that is mounted on and holds the dielectric member 62. In still other embodiments, the housing 12 includes both an electrically conductive material 64 that is a coating and an electrically conductive material 64 that is a discrete shell that is mounted on and holds the dielectric member 62. When the electrically conductive material 64 is a coating, the coating may be applied on dielectric member 62 using any method, process, structure, means, and/or the like. Examples of suitable processes for applying the coating of the electrically conductive material 64 on the dielectric member 62 include, but are not limited to, chemical solution deposition (CSD), chemical vapor deposition (CVD), physical vapor deposition (PVD), atomic layer deposition (ALD), electrodeposition, electrocoating, electroplating, plastic plating, screen printing, dip coating, aerosol coating, spin coating, sputtering, and/or the like. As used herein, the electrically conductive material 64 is considered to be a coating when the electrically conductive material 64 is applied on the dielectric member 62 using a plating process.

Figure 9:
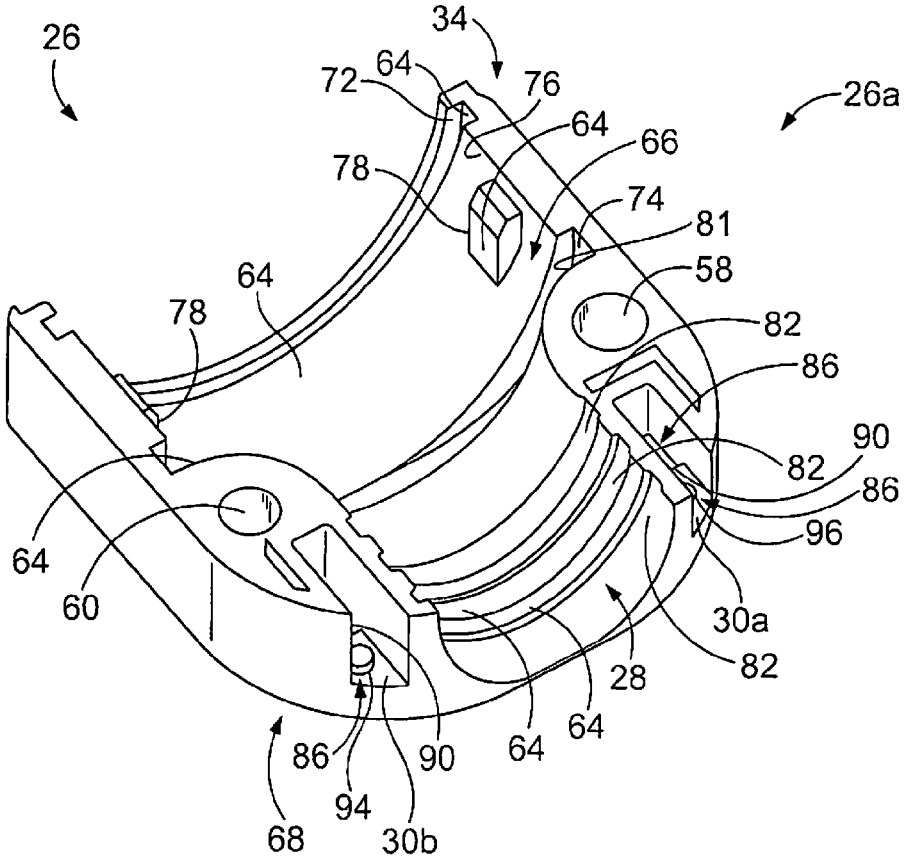
FIG. 9 is a perspective view of an exemplary embodiment of a sub-shell of an exemplary embodiment of a back shell of the electrical connector shown in FIGS. 1 and 2.

FIG. 9 is a perspective view of an exemplary embodiment of the sub-shell 26*a* of an exemplary embodiment of the back shell 26. The sub-shell 26*b* is shown in FIGS. 1 and 2. In the exemplary embodiment, the sub-shells 26*a* and 26*b* are substantially identical and are hermaphroditic. Accordingly, only the sub-shell 26*a* will be described in detail herein. The sub-shell 26*a* includes an interior side 66 and an opposite exterior side 68. In the exemplary embodiment, the sub-shell 26*a* includes one of the openings 58 and one of the threaded holes 60. Alternatively, the sub-shell 26*a* includes all of the openings 58 (wherein the sub-shell 26*b* includes all of the threaded holds 60) or includes all of the threaded holes 60 (wherein the sub-shell 26*b* includes all of the openings 58).

The housing end 34 of the sub-shell 26*a* is configured to be mounted to a fitting 70 (FIGS. 10 and 11) of the housing 12 (FIGS. 1, 2, 10, and 11). In the exemplary embodiment, the interior side 66 of the sub-shell 26*a* includes a curved shape at the housing end 34 that is complementary with a shape of the fitting 70. But, the interior side 66 of the sub-shell 26*a* may additionally or alternatively include any other shape, whether or not such a shape is complementary with a shape of the fitting 70.

The sub-shell 26*a* optionally includes a groove 72 and/or a groove 74 that extends into the interior side 66. Each of the grooves 72 and 74 extends at the housing end 34. The grooves 72 and 74 are spaced apart along the length of the back shell 26 such that a platform 76 is defined between the grooves 72 and 74. As will be described below, the grooves 72 and 74 facilitate mounting the back shell 26 to the fitting 70 of the housing 12. In some embodiments, the sub-shell 26*a* does not include the groove 72 and/or does not include the groove 74.

The sub-shell 26*a* includes one or more flats 78 that extend along the interior side 66 at the housing end 34. Any number of flats 78 may be provided. In the exemplary embodiment, the sub-shell 26*a* include two flats 78. The flats 78 engage corresponding flats 80 (FIG. 10) of the housing 12 to limit rotation of the back shell 26 relative to the housing 12, as will be described below. The flats 78 interrupt the curved shape of the interior side 66 of the sub-shell 26*a* along the housing end 34 such that a portion of the interior side 66 is not curved at the housing end 34. The electrically conductive material 64 may define at least a portion of an exterior surface of the interior side 66 at the platform 76, at an interior wall 81 of the sub-shell 26*a*, within the grooves 72 and/or 74, at the flats 78, and/or the like to enable the sub-shell 26*a* to electrically connect to the fitting 70 of the housing 12. Each flat 78 may be referred to herein as a "shell flat".

As described above, the back shell 26 includes the opening 28 that holds the end 20 (FIGS. 1 and 11) of the cable 22 (FIGS. 1, 3-6, 11, and 16). The sub-shell 26*a* defines half of the opening 28, which extends through the cable end 36 of the sub-shell 26*a*. The other half of the opening 28 is defined by the sub-shell 26*b*. At the opening 28, the interior side 66 of the sub-shell 26*a* includes one or more compression grooves 82 that engage the cable shield 426 (FIGS. 6 and 11) or an intermediary component (e.g., the conductive tape 84 described below) to facilitate holding the end 20 of the cable 22 to the back shell 26, as will be described below. The compression grooves 82 may also provide strain relief. Although three are shown, the sub-shell 26*a* may include any number of the compression grooves 82. The electrically conductive material 64 may define at least a portion of an exterior surface of the interior side 66 at the opening 28 (e.g., within and/or between the compression grooves 82) and/or the like to enable the sub-shell 26*a* to electrically connect to the shield 426 of the housing 12.

The sub-shell 26*a* includes two sub-sockets 30*a* and 30*b*. Each sub-socket 30*a* and 30*b* defines half of a corresponding accessory socket 30 of the back shell 26. When the sub-shells 26*a* and 26*b* are connected together, the sub-socket 30*a* of the sub-shell 26*a* is aligned with and open to a sub-socket 30*b* (FIG. 2) of the sub-shell 26*b* to form a corresponding accessory socket 30 of the back shell 26. Similarly, the sub-socket 30*b* of the sub-shell 26*a* is aligned with and open to a sub-socket 30*a* (FIG. 2) of the sub-shell 26*b* to form a corresponding accessory socket 30 of the back shell 26.

Referring now to FIGS. 2 and 9, each accessory socket 30 of the back shell 26 may include one or more retention features 86 that cooperates with one or more retention members 88 (not shown in FIG. 9) of the accessory 32 (not shown in FIG. 9) to hold the accessory 32 within the accessory socket 30. The retention features 86 and the retention members 88 may each be any type of retention element that forms a connection using any structure, method, means, and/or the like, such as, but not limited to, a notch, a tab, a peg, a receptacle, a snap-fit connection, an interference (press) fit connection, a latch, an adhesive, and/or the like. In the exemplary embodiment, each sub-socket 30*a* and 30*b* of the sub-shell 26*a* includes a notch 90 (not visible in FIG. 2) that receives a corresponding tab 92 (not shown in FIG. 9) of the base 38 (not shown in FIG. 9) of the accessory 32 therein. When the sub-shells 26*a* and 26*b* are connected together, each accessory socket 30 includes opposing notches 90 that receive opposite tabs 92 of the accessory 32 therein. In the exemplary embodiment, the sub-sockets 30*b* include a peg 94 and the sub-sockets 30*a* include a receptacle 96 (not visible in FIG. 2). The peg 94 of the sub-socket 30*b* is received within a receptacle 98 (not shown in FIG. 9) that extends within the base 38 of a corresponding accessory 32. The peg 94 and receptacle 98 engage each other with an interference-fit in the exemplary embodiment. The receptacle 96 of the sub-socket 30*a* receives a peg (not shown) that extends outwardly from the base 38 of the accessory 32. In the exemplary embodiment, the peg and the receptacle 96 engage each other with an interference-fit. When the sub-shells 26*a* and 26*b* are connected together, each accessory socket 30 includes a peg 94 and an opposing receptacle 96. In some alternative embodiments, both the sub-sockets 30*a* and 30*b* of the sub-shell 26*a* include a peg 94, while both of the sub-sockets 30*a* and 30*b* of the sub-shell 26*b* include a receptacle 96, or vice versa.

Figure 10:
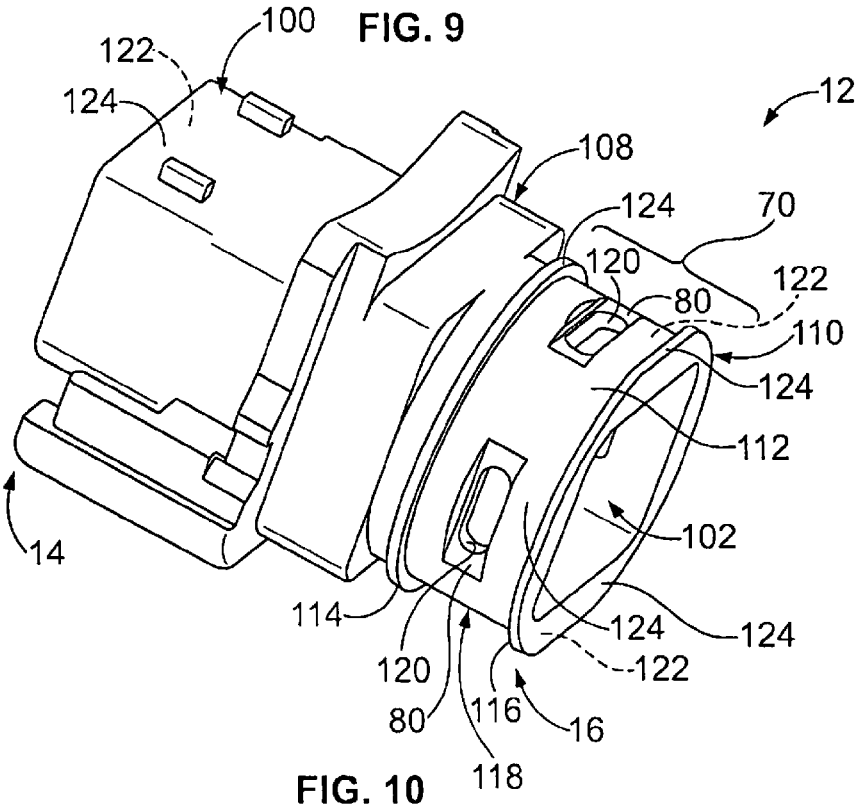
FIG. 10 is a perspective view of an exemplary embodiment of a housing of the electrical connector shown in FIGS. 1 and 2.

FIG. 10 is a perspective view of an exemplary embodiment of the housing 12 of the electrical connector 10. The housing 12 extends between the mating end 14 and the cable end 16. The housing 12 is configured to mate with the mating connector (not shown) at the mating end 14. In the exemplary embodiment, the mating end 14 of the housing 12 includes a plug 100 that is configured to be received within a receptacle (not shown) of the mating connector. Alternatively, the mating end 14 of the housing 12 includes a receptacle (not shown) that is configured to receive a plug (not shown) of the mating connector therein. In the exemplary embodiment, the housing 12 includes an interior cavity 102 for holding a dielectric insert 104 (FIG. 11) that holds one or more electrical contacts 106 (FIG. 11) of the electrical connector 10. In addition or alternatively, the housing 12 includes one or more contact cavities (not shown) for directly holding one or more of the electrical contacts 106 of the electrical connector 10.

The cable end 16 of the housing 12 includes a fitting 70. The fitting 70 is configured to hold the back shell 26 (FIGS. 1-6, 9, 11, and 16). More specifically, the back shell 26 mounts to the fitting 70, as will be described below. The fitting 70 extends a length outwardly from a central segment 108 of the housing 12 to an end 110. The cable end 16 of the housing 12 includes the end 110 of the fitting 70. The fitting 70 includes an exterior surface 112, which as can be seen in FIG. 2 defines an outer profile of the fitting 70. In the exemplary embodiment, the outer profile of the fitting 70 has a circular shape. Alternatively, the outer profile of the fitting 70 includes any other shape. The fitting 70 may be referred to herein as a "shield fitting".

Optionally, the fitting 70 includes one or more flanges 114 and/or 116 that extend radially outwardly at the exterior surface 112. The flange 116 optionally extends at the end 110. The flanges 114 and 116 are spaced apart along the length of the fitting 70 such that a recess, or groove, 118 is defined between the flanges 114 and 116. As described below, the flanges 114 and 116 facilitate holding the back shell 26 on the fitting 70.

The fitting 70 optionally includes one or more of the flats 80. More specifically, the exterior surface 112 of the fitting 70 includes the flats 80 such that the outer profile of the fitting 70 includes the flats 80. The flats 80 interrupt the circular shape of the outer profile of the fitting 70 such that a segment of the length of the fitting 70 has an outer profile that is not completely circular. The fitting 70 may include any number of the flats 80 for cooperating with any number of flats 78 (FIG. 9) of the back shell 26. Moreover, each of the flats 80 may extend at any location along the length and outer profile of the fitting 70 relative to the fitting 70 and relative to each other. In the exemplary embodiment, the fitting 70 includes four flats 80 that are arranged approximately 90° from each other along the outer profile of the fitting 70. Each of the flats 80 may be referred to herein as a "fitting flat".

The fitting 70 optionally includes one or more openings 120 that extend through the fitting 70 into the interior cavity 102 of the housing 12. In embodiments wherein the cable 22 (FIGS. 1, 3-6, 11, and 16) includes one or more drain wires (not shown), each opening 120 is configured to receive a corresponding drain wire. Any number of the openings 120 may be provided for receiving any number of drain wires of the cable 22. Moreover, each of the openings 120 may extend at any location along the length and outer profile of the fitting 70 relative to the fitting 70 and relative to each other. In the exemplary embodiment, the fitting 70 includes four openings 120 that extend through the flats 80 and are arranged approximately 90° from each other along the outer profile of the fitting 70.

Optionally, the housing 12 includes both a dielectric member 122 and an electrically conductive material 124. The electrically conductive material 124 enables the housing 12 to electrically connect to the shield 426 (FIGS. 6 and 11) of the cable 22, via the back shell 26, and to form a portion of an electrical circuit (e.g., an electrical ground, a shield circuit, and/or the like) that includes the shield 426. The electrically conductive material 124 may extend on any amount, any portion(s), and any location(s) of the dielectric member 122 that enables the housing 12 to electrically connect to the shield 426 and form a portion of the electrical circuit that includes the shield 426. In the exemplary embodiment, the electrically conductive material 124 extends on the dielectric member 122 at the fitting 70 to enable the housing 12 to electrically connect to the shield 426 through the back shell 26. In other words, the electrically conductive material 124 forms at least a portion of the exterior surface 112 of the fitting 70. The electrically conductive material 124 may extend on the dielectric member 122 along the plug 100 of the housing 12, and/or on another location of the housing 12, to enable the housing 12 to electrically connect the cable shield 426 to a housing (not shown) and/or another component of the mating connector. In some embodiments, the housing 12 does not include the dielectric member 122 or does not include the electrically conductive material 124.

In some embodiments, the electrically conductive material 124 is a coating that coats one or more surfaces of the dielectric member 122. In other embodiments, the electrically conductive material 124 is a discrete shell that is mounted on and holds the dielectric member 122. In still other embodiments, the housing 12 includes both an electrically conductive material 124 that is a coating and an electrically conductive material 124 that is a discrete shell that is mounted on and holds the dielectric member 122. When the electrically conductive material 124 is a coating, the coating may be applied on dielectric member 122 using any method, process, structure, means, and/or the like. Examples of suitable processes for applying the coating of the electrically conductive material 124 on the dielectric member 122 include, but are not limited to, chemical solution deposition (CSD), chemical vapor deposition (CVD), physical vapor deposition (PVD), atomic layer deposition (ALD), electrodeposition, electrocoating, electroplating, screen printing, dip coating, aerosol coating, plastic plating, spin coating, sputtering, and/or the like. As used herein, the electrically conductive material 124 is considered to be a coating when the electrically conductive material 124 is applied on the dielectric member 122 using a plating process. Whether or not the electrically conductive material 124 is a coating and/or a discrete shell, the electrically conductive material 124 and/or the housing 12 overall may be referred to as a "shell".

Figure 11:
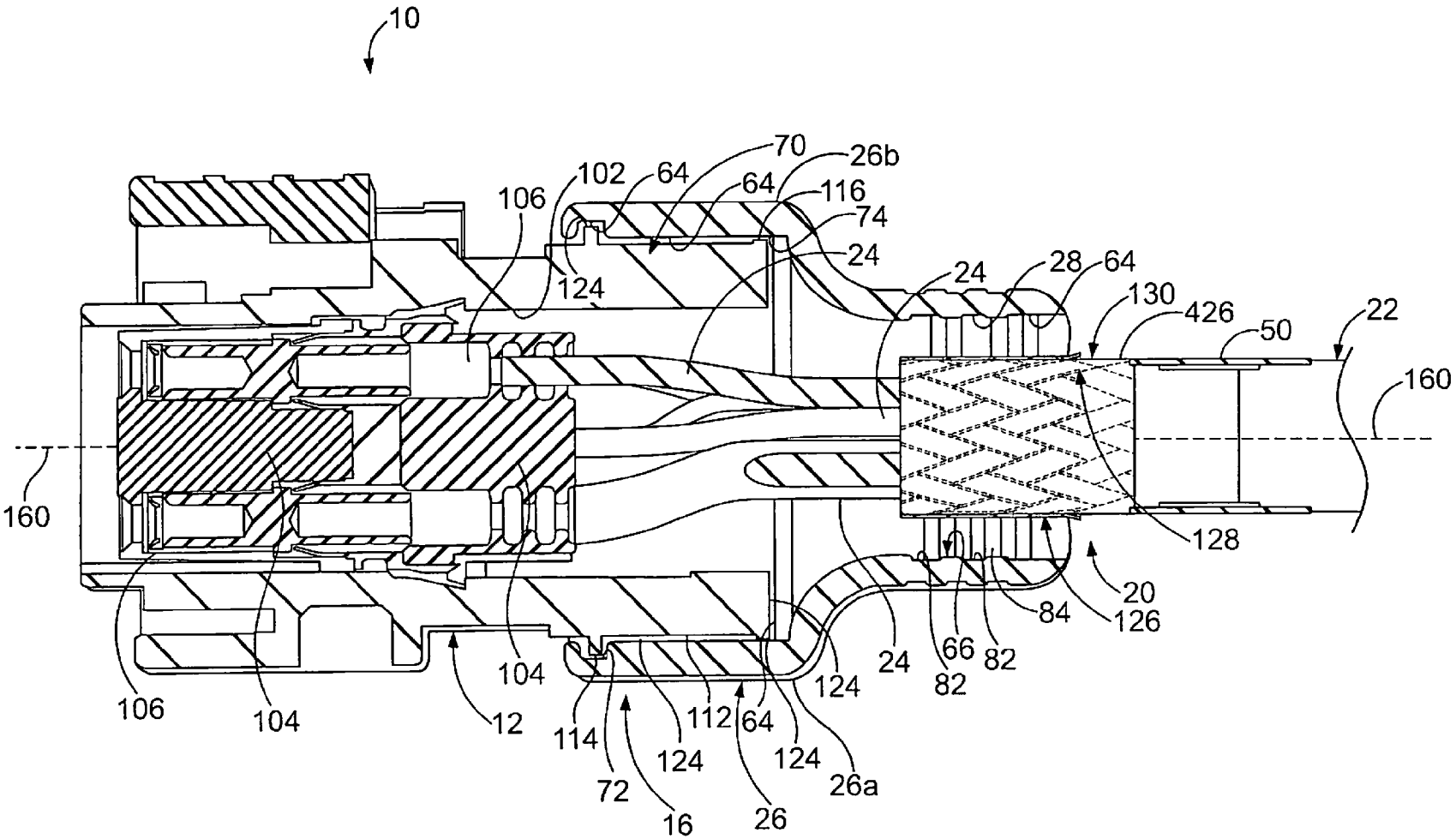
FIG. 11 is a cross-sectional view of the electrical connector shown in FIGS. 1 and 2.

FIG. 11 is a cross-sectional view of the electrical connector 10. The electrical contacts 106 of the electrical connector 10 are terminated to the ends of the wires 24, such as, but not limited to, by a crimp connection and/or the like. The cable 22 includes the shield 426, which circumferentially surrounds the wires 24. The shield 426 provides electrical shielding for the wires 24 along the length of the cable 22. The jacket 50 of the cable 22 circumferentially surrounds the shield 426. The shield 426 is electrically conductive and may be a braid, a sheath, metallic armor, and/or the like. In addition or alternatively to the shield 426, the cable 22 may include one or more drain wires (not shown). Although in the exemplary embodiment the electrical contacts 106 are held by the dielectric insert 104 that is held within the interior cavity 102 of the housing 12, in addition or alternatively the housing 12 includes one or more contact cavities (not shown) that directly holding one or more of the electrical contacts 106.

The back shell 26 holds the end 20 of the cable 22 such that the back shell 26 supports the cable end 20. More specifically, the cable 22 extends through the opening 28 within the back shell 26. Optionally, an exposed segment of the shield 426 of the cable 22 is circumferentially surrounded by an electrically conductive intermediary component, such as, but not limited to, a generally rigid or generally compressible spacing member, an electrically conductive tape or other wrapping, an adhesive, and/or the like. In the exemplary embodiment, the exposed segment of the shield 426 is circumferentially surrounded by the electrically conductive tape 84. At the opening 28, the tape 84 is engaged between an exterior surface 126 of the shield 426 and the interior side 66 of the back shell 26 such that the back shell 126 is electrically connected to the shield 426 via the conductive tape 84. More specifically, the electrically conductive material 64 of the interior side 66 of the back shell 26 is engaged with the tape 84 at the opening 28. The compression grooves 82 facilitate a grip (e.g., a stiction, a friction, and/or the like) between the tape 84 and the back shell 26. Optionally, the tape 84 is compressed between the shield 426 and the back shell 26, which may be provided, facilitated, and/or the like by the compression grooves 82.

In some alternative embodiments, the interior side 66 of the back shell 26 engages the exterior surface 126 of the shield 426 to electrically connect the back shell 26 to the shield 426. In the exemplary embodiment, the shield 426 is folded over itself such that the exterior surface 126 that engages the tape 84 is defined by an interior side 128 of the shield 426. Alternatively, the shield 426 is not folded over itself and the exterior surface of the shield 426 that engages the tape 84 is defined by an exterior side 130 of the shield 426.

The back shell 26 is mounted to the cable end 16 of the housing 12. More specifically, the back shell 26 is mounted to the fitting 70 of the cable end 16 of the housing 12. The sub-shells **26*a* and 26*b* are connected together. The flanges 114 and 116 of the housing 12 are received within the respective grooves 72 and 74 of the back shell 26 to limit relative movement between the back shell 26 and the housing 12 along the central longitudinal axis 160 of the electrical connector 10. Although not visible in FIG. 11, the flats 78 (FIG. 9) of the back shell 26 are engaged with the corresponding flats 80 (FIG. 10) of the fitting 70 of the housing 12 to limit rotation of the back shell 26 relative to the housing 12. Optionally, an interface between the flange 114 and the groove 72 forms an electrical circuit such that the interface between the flange 114 and the groove 72 facilitates blocking, containing, and/or the like electromagnetic interference (EMI) emissions. The interface between the flange 114 and the groove 72** optionally includes one or more spring fingers, a canted coil spring, and/or the like to facilitate forming the electrical circuit.

The back shell 26 is electrically connected to the housing 12 via engagement of the electrically conductive material 64 of the interior side 66 of the back shell 26 with the electrically conductive material 124 of the exterior surface 112 of the fitting 70. The electrically conductive materials 64 and 124 of the back shell 26 and the housing 12, respectively, provide an electrical path from the shield 426 of the cable 22, through and/or along the back shell 26 and the housing 12, to the mating connector. In some alternative embodiments, the back shell 26 and the housing 12 are electrically connected via an intermediary component, such as, but not limited to, a generally rigid or generally compressible spacing member, an electrically conductive tape or other wrapping, an adhesive, and/or the like.

Figure 13:
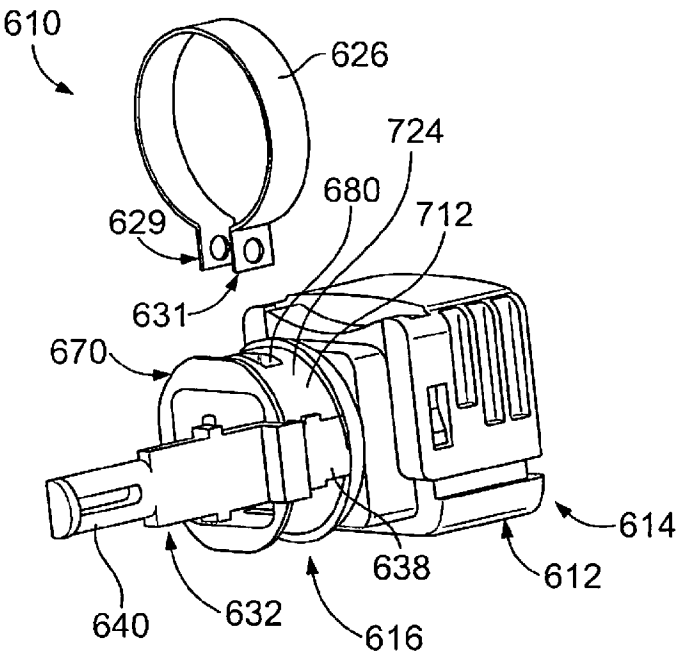
FIG. 13 is an exploded perspective view of the electrical connector shown in FIG. 12.
Figure 12:
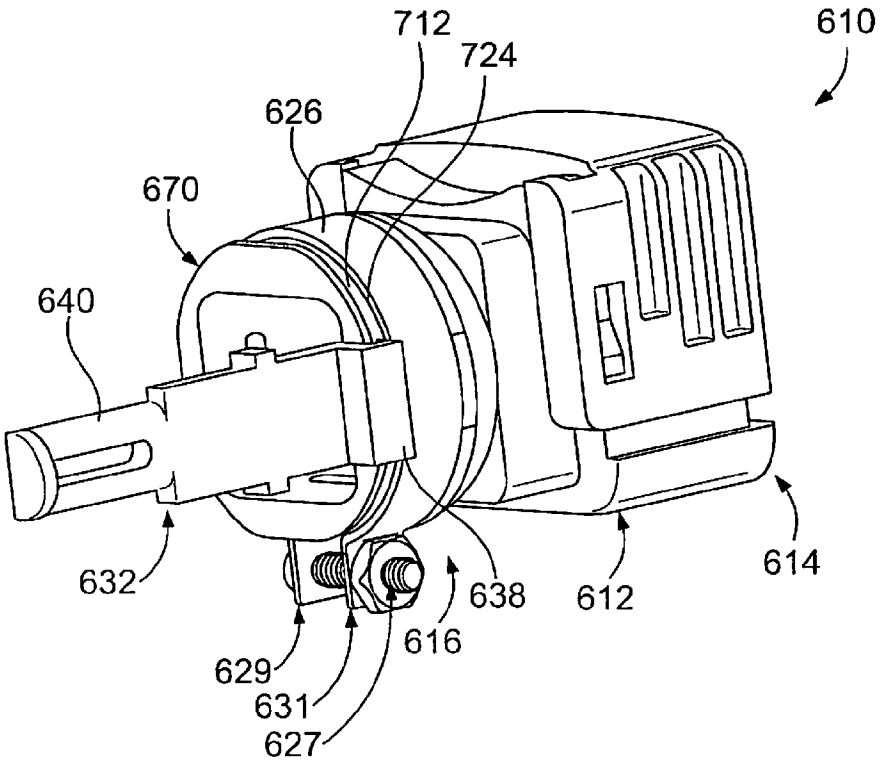
FIG. 12 is a perspective view of an exemplary alternative embodiment of an electrical connector.

FIG. 12 is a perspective view of an exemplary alternative embodiment of an electrical connector 610. FIG. 13 is an exploded perspective view of the electrical connector 610. Referring to FIGS. 12 and 13, the electrical connector 610 includes a housing 612 and one or more accessories 632 that are mounted to the housing 612 using a strap 626. The housing 612 extending between a mating end 614 and a cable end 616. The electrical connector 610 is configured to mate with a mating connector (not shown) at the mating end 614 of the housing 612. The electrical connector 610 is configured to terminate the end 20 (FIGS. 1 and 11) of the cable 22 (FIGS. 1, 3-6, 11, and 16) at the cable end 616.

The cable end 616 of the housing 612 includes a fitting 670. The strap 626 mounts to the fitting 670, as will be described below. The fitting 670 includes an exterior surface 712, which defines an outer profile of the fitting 670. In the exemplary embodiment, the outer profile of the fitting 670 has a circular shape. Alternatively, the outer profile of the fitting 670 includes any other shape. The exterior surface 712 of the fitting 670 optionally includes one or more flats 680 (not visible in FIG. 12). Optionally, the housing 612 includes an electrically conductive material 724, for example to enable the housing 612 to electrically connect to the shield 426 (FIGS. 6 and 11) and/or one or more drain wires (not shown) of the cable 22 via engagement therewith or via an intermediary component, such as, but limited to, the accessory 632. The fitting 670 may be referred to herein as a "shield fitting". Each of the flats 680 may be referred to herein as a "fitting flat".

The strap 626 is mounted to the housing 612 by being strapped over the cable end 616 of the housing 612. More specifically, the strap 626 is strapped over the fitting 670 of the housing 612 such that the strap circumferentially surrounds the outer profile of the fitting 670. Although shown as having a circular shape that is complementary to the circular outer profile of the fitting 670, the strap 626 may additionally or alternatively include any other shape, whether such complementary with the shape of the outer profile of the fitting 670.

An accessory 632 extends outwardly from the strap 626 and is configured to engage the cable 22. The strap 626 secures the accessory 632 to the housing 612, and more specifically to the fitting 670. Optionally, and as best seen in FIG. 13, a base 638 of the accessory 632 engages a corresponding flat 680 of the fitting 670 to facilitate supporting the accessory 632 and/or to limit rotational movement of the accessory 632 along the outer profile of the fitting 670. The strap 626 extends around the base 638 of the accessory 632 to hold the base 638 between the strap 626 and the exterior surface 712 of the fitting 670, and thereby secure the accessory 632 to the housing 612. The strap may be tightened around the base 638 and the fitting 670 using any method, connection type, structure, means, and/or the like, such as, but not limited to, using a fastener, using an adhesive, using a threaded fastener, using a latch, using an elastic and/or resilient property of the strap 626 (e.g., providing the strap 626 as an elastic band), shrinking and/or recovering (e.g., heat shrink and/or recover) the strap 626 to tighten the strap 626 around the base 638 and the fitting, and/or the like. In the exemplary embodiment, the strap 626 includes a captive threaded fastener 627 (not shown in FIG. 13) that brings and holds ends 629 and 631 of the strap 626 together to tighten the strap 626.

Optionally, an end of the shield 426 (FIGS. 6 and 11) of the cable 22 is held on the fitting 670 between the base 638 and the strap 626 or between the base 638 and the exterior surface 712 of the fitting 670. In other words, the strap 626 is optionally strapped over the end of the shield 426 and the fitting 670 for holding the shield 426 on the fitting 670. The shield 426 may be electrically connected to the housing 612 via engagement of the shield 426 with the fitting 670, via engagement of the shield 426 with the base 638 of the accessory 632, and/or via engagement of the shield 426 with a ground beam (not shown) of the accessory 632.

Although only one is shown, the electrical connector 610 may include any number of the accessories 632. In exemplary embodiment, the accessory 632 includes a tie bar 640. But, the accessory 632 is merely one example of a type of accessory that may be used with the strap 626. The electrical connector 610 is not limited to the accessory 632 shown and described with respect to FIGS. 12 and 13, but rather any other type(s) of accessories may be used with the strap 626. Examples of other accessories that may be used with the strap 626 include, but are not limited to, the accessories 132, 232, 332, and/or 432. Moreover, the electrical connector 610 may include two or more different types of accessories. In some embodiments, a single accessory extends from two or more different locations on the strap 626.

Figure 14:
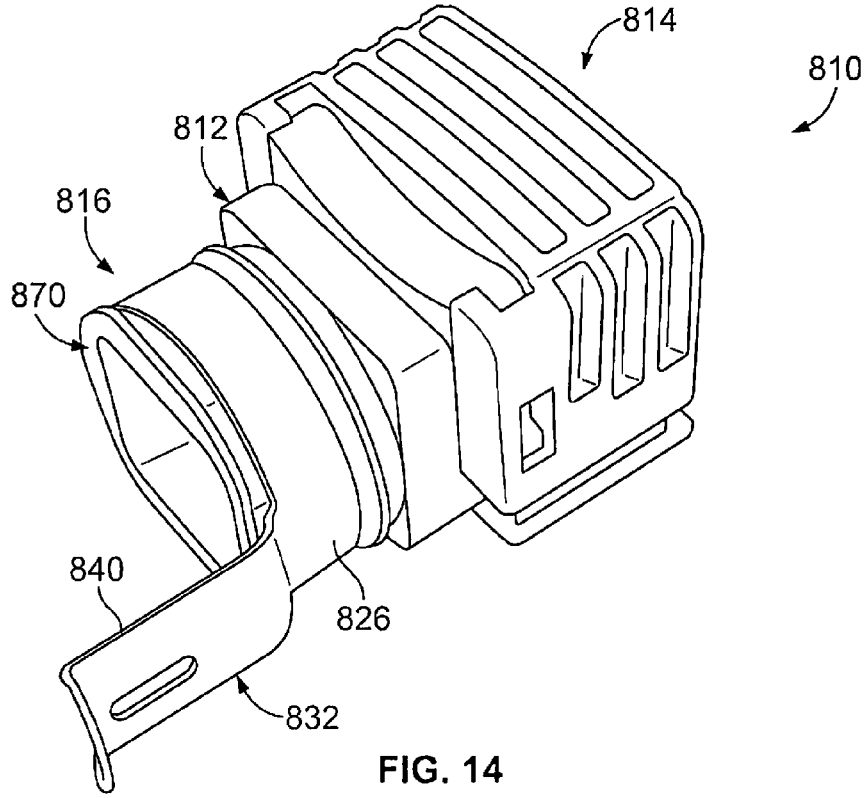
FIG. 14 is a perspective view of another exemplary alternative embodiment of an electrical connector.

FIG. 14 is a perspective view of another exemplary alternative embodiment of an electrical connector 810. The electrical connector 810 includes a housing 812 and one or more accessories 832 that are mounted to the housing 812 using a strap 826. The accessory 832 is integrally formed with the strap 826.

The housing 812 extends between a mating end 814 and a cable end 816. The cable end 816 of the housing 812 includes a fitting 870. The strap 826 is strapped over the fitting 870 of the housing 812. An accessory 832 extends outwardly from the strap 826 and is configured to engage the cable 22 (FIGS. 1, 3-6, 11, and 16). The accessory 832 is integrally formed with the strap 826. Alternatively, the accessory 832 is separately formed relative to the strap 826 as a discrete component and thereafter connected to the strap 826 (e.g., using an adhesive, a fastener, and/or the like). The fitting 870 may be referred to herein as a "shield fitting".

Although only one is shown, the electrical connector 810 may include any number of the accessories 832. In exemplary embodiment, the accessory 832 includes a tie bar 840. But, the accessory 832 is merely one example of a type of accessory that may be used with the strap 826. The electrical connector 810 is not limited to the accessory 832 shown and described with respect to FIG. 14, but rather any other type(s) of accessories may be used with the strap 826. Examples of other accessories that may be used with the strap 826 include, but are not limited to, the accessories 132, 232, 332, and/or 432. Moreover, the electrical connector 810 may include two or more different types of accessories. In some embodiments, a single accessory extends from two or more different locations on the strap 826.

Figure 15:
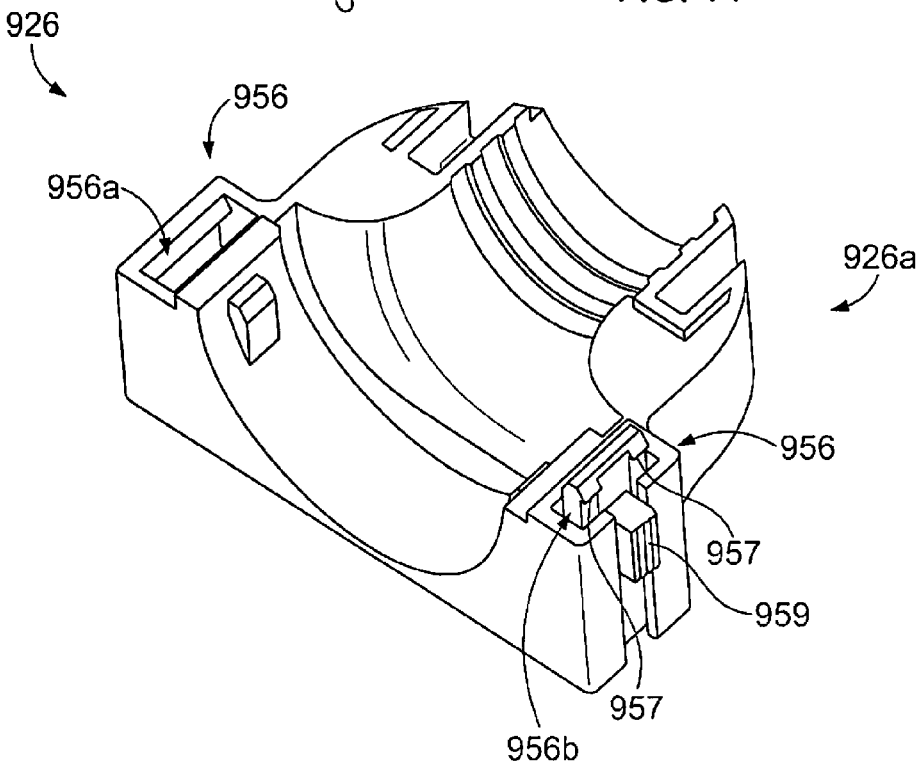
FIG. 15 is a perspective view of a portion of an exemplary alternative embodiment of a back shell of the electrical connector shown in FIGS. 1 and 2.

FIG. 15 is a perspective view of a portion of an exemplary alternative embodiment of a back shell 926 of the electrical connector 10 (FIGS. 1-6 and 11). The back shell 926 includes a pair of discrete sub-shells that connect together to define the back shell 926. In the exemplary embodiment, the sub-shells are substantially identical. Accordingly, only one sub-shell 926*a* of the pair of sub-shells that define the back shell 926 will be described and illustrated herein.

The pair of sub-shells of the back shell 926 connect together using latches 956. Each latch 956 includes a latch opening and a latch arm that cooperates with the latch opening to latch the sub-shells of the back shell 926 together. More specifically, the sub-shell 926*a* includes a latch opening 956*a* and a latch arm 956*b*. The latch arm 956*b* includes a latch shoulder 957. The latch arm 956*b* is received within a latch opening (not shown) of the other sub-shell of the back shell 926 such that the latch shoulder 957 engages a latch shoulder (not shown) of the latch opening of the other sub-shell. The latch opening 956*a* receives a latch arm (not shown) of the other sub-shell of the back shell 926 such that a latch shoulder (not shown) of the latch opening 956*a* engages a latch shoulder (not shown) of the latch arm of the other sub-shell. To disengage the latch 956, the latch arm 956*b* includes a button 959 that is pressed to move the latch arm 956*b*, against a bias thereof, to disengage the latch shoulder 957 from the latch shoulder of the latch opening of the other sub-shell. The latch arm 956*b* can then be removed from the latch opening of the other sub-shell to disconnect the sub-shell 926*a* from the other sub-shell of the back shell 926. The latch opening 956*a* and the latch arm 956*b*, as well as the latch opening and latch arm of the other sub-shell, may be referred to herein as "latch mechanisms".

In the exemplary embodiment, the sub-shell 926*a* includes both a latch opening 956*a* and a latch arm 956*b*. Alternatively, the sub-shell 926*a* includes all of the latch openings 956*a* (wherein the other sub-shell includes all of the latch arms 956*b* or includes all of the larch arms 956*b* (wherein the other sub-shell includes all of the latch openings 956*a*).

Figure 16:
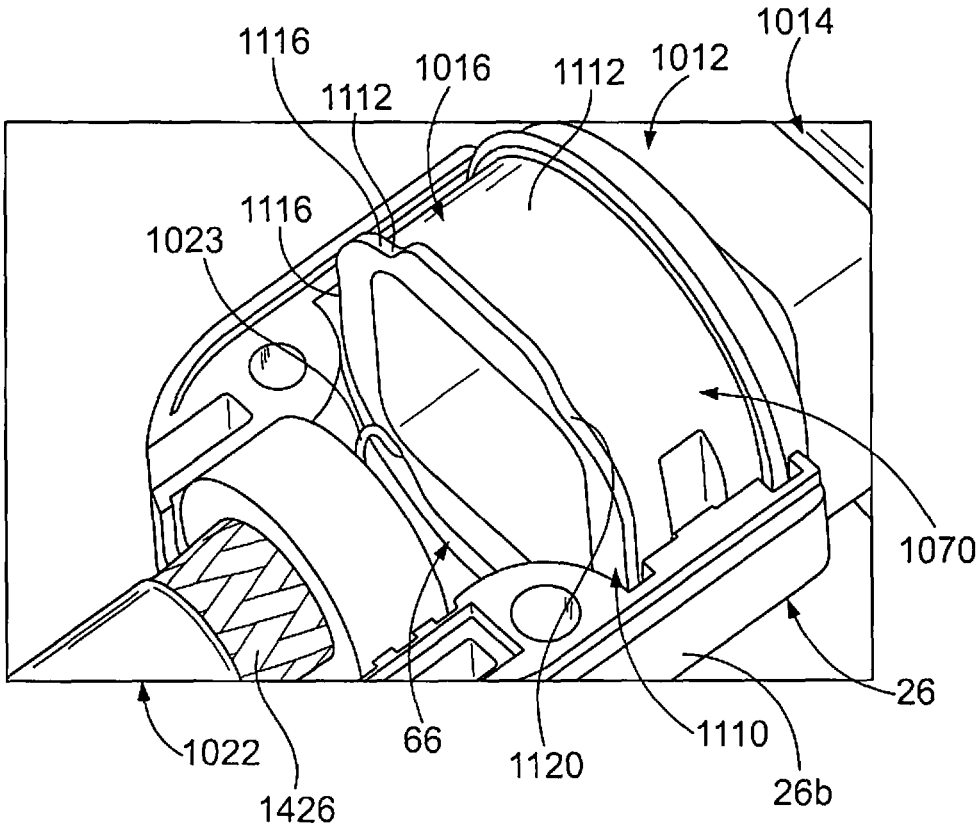
FIG. 16 is a perspective view illustrating an exemplary alternative embodiment of a housing that may be used with the electrical connector shown in FIGS. 1 and 2.

FIG. 16 is a perspective view illustrating an exemplary alternative embodiment of a housing 1012 that may be used with the electrical connector 10 (FIGS. 1-6 and 11). The housing 1012 extends between a mating end 1014 and a cable end 1016. In the exemplary embodiment of FIG. 16, a cable 1022 includes one or more drain wires 1023. The cable end 1016 of the housing 1012 includes a fitting 1070. The sub-shell 26*b* of the back shell 26 is shown in FIG. 16 mounted to the fitting 1070. Although only one is shown, the cable 1022 may include any number of drain wires 1023. In the exemplary embodiment, the cable 1022 includes a shield 1426 in addition to the drain wire 1023. Alternatively, the cable 1022 does not include the shield 1426. The fitting 1070 may be referred to herein as a "shield fitting".

The fitting 1070 of the housing 1012 includes a flange 1116 that optionally extends at an end 1110 of the fitting 1070. One or more notches 1120 extend into the flange 1116. Each notch 1120 is configured to receive a corresponding drain wire 23 therethrough. The flange 1116 may include any number of the notches 1120 for receiving any number of drain wires 23 of the cable 22. Moreover, each of the notches 1120 may extend at any location along the circumference of the flange 1116 relative to the flange 1116 and relative to each other. In the exemplary embodiment, the flange 1116 includes four notches 1120 that are arranged approximately 90° from each other along the circumference of the flange 1116.

As can be seen in FIG. 16, the drain wire 23 extends through the notch 1120 and further along the fitting 1070 toward the mating end 1014 of the housing 1012. The drain wire 23 extends within the notch 1120 between the flange 1116 and the interior side 66 of the back shell 26. The drain wire 23 may be engaged with an exterior surface 1112 of the fitting 1070 to electrically connect the drain wire 23 to the housing 1012. Although shown for use with an electrical connector (e.g., the electrical connector 10) that includes the back shell 26, the housing 1012 may be used with an electrical connector that does not include a back shell (e.g., the electrical connectors 610 and/or 810). In such an embodiment, and for example, the drain wire 1023 is optionally captured between a strap (e.g., the strap 626 and/or the strap 826) and the fitting 1070.

The embodiments described and/or illustrated herein may provide a back shell that is interchangeable between housings having different configurations. The embodiments described and/or illustrated herein may provide a housing that is interchangeable between back shells having different configurations.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for terminating a cable, the electrical connector comprising:

an electrical contact configured to be terminated to a wire of the cable;

a housing extending between a mating end and a cable end, the housing being configured to mate with a mating connector at the mating end, the electrical contact being held by the housing;

a back shell mounted to the cable end of the housing, the back shell comprising discrete sub-shells that connect together to define the back shell, the back shell including an opening configured to hold an end of the cable such that the back shell supports the end of the cable, the back shell comprising an accessory socket, the sub-shells comprising sub-sockets that are aligned and open to each other to define the accessory socket; and an accessory held within the accessory socket of the back shell such that the accessory extends outwardly from the back shell, the accessory being configured to engage the cable.

2. The electrical connector of claim 1, wherein the accessory comprises a tie bar that is configured to be held against the cable using a fastener that is configured to at least one of extend around the tie bar and the cable or extend around the cable and through an opening of the tie bar.

3. The electrical connector of claim 1, wherein the accessory comprises a clip having a cradle, the clip being configured to snap over the cable such that the cradle holds the cable therein.

4. The electrical connector of claim 1, wherein the accessory comprises a shield configured to shield the cable from at least one of heat, electromagnetic interference, cold, fluid, moisture, or debris.

5. The electrical connector of claim 1, wherein the cable includes a shield providing electrical shielding around the wire, the accessory comprising a ground beam that is configured to engage, and electrically connect to, the shield of the cable.

6. The electrical connector of claim 1, wherein the back shell extends a length from a housing end to a cable end, the accessory socket extending into the back shell through the cable end of the back shell.

7. The electrical connector of claim 1, wherein the socket comprises a retention feature that cooperates with a retention member of the accessory to hold the accessory within the accessory socket, the retention feature comprising at least one of a tab, a notch, a peg, or a receptacle.

8. The electrical connector of claim 1, wherein the opening of the back shell and the accessory socket of the back shell are separate from one another.

9. An electrical connector for terminating a cable having a drain wire, the electrical connector comprising:

an electrical contact configured to be terminated to a wire of the cable;

a housing extending from a mating end to a cable end and comprising an interior cavity, the housing being configured to mate with a mating connector at the mating end, the cable end having a fitting that includes an outer profile having a circular shape, the outer profile of the fitting comprising a fitting flat, the electrical contact being held by the housing within the interior cavity, the interior cavity having an entrance at the fitting that is configured to receive the cable therethrough, the fitting comprising at least one of an opening that is configured to receive the drain wire therethrough or a flange having a notch that is configured to receive the drain wire therethrough, wherein the at least one of the opening or the notch is separate from the entrance to the interior cavity; and a back shell mounted to the fitting of the cable end of the housing, the back shell including an opening configured to hold an end of the cable such that the back shell supports the end of the cable, the back shell comprising a shell flat that engages the fitting flat of the housing to limit rotation of the back shell relative to the housing.

10. The electrical connector of claim 9, wherein the back shell comprises discrete sub-shells that connect together to define the back shell, the back shell further comprising a latch defined by latch mechanisms of the sub-shells that cooperate to latch the sub-shells together.

* * * * *